US006708497B2

(12) United States Patent
Doebbeling et al.

(10) Patent No.: US 6,708,497 B2
(45) Date of Patent: Mar. 23, 2004

(54) GAS TURBINE INSTALLATION AND AN ASSOCIATED OPERATING METHOD

(75) Inventors: Klaus Doebbeling, Windisch (CH); Hans-Erik Hansson, Finspong (SE); Dieter Winkler, Lauchringen (DE)

(73) Assignee: Alstom Technology Ltd, Baden (CH)

( * ) Notice: Subject to any disclaimer, the term of this patent is extended or adjusted under 35 U.S.C. 154(b) by 25 days.

(21) Appl. No.: 10/183,871

(22) Filed: Jun. 28, 2002

(65) Prior Publication Data

US 2003/0014977 A1 Jan. 23, 2003

(30) Foreign Application Priority Data

Jul. 13, 2001 (CH) ..... 2001 1290/01

(51) Int. Cl.[7] ..... F02C 3/30
(52) U.S. Cl. ..... 60/775; 60/39.55; 60/39.511
(58) Field of Search ..... 60/775, 39.511, 60/39.55

(56) References Cited

U.S. PATENT DOCUMENTS 5,513,488 A 5/1996 Fan
6,247,302 B1 * 6/2001 Tsukamoto et al. ..... 60/39.511
2003/0070415 A1 * 4/2003 Hatamiya et al. ..... 60/39.511

FOREIGN PATENT DOCUMENTS

EP 0843083 A2 5/1998
WO WO98/01658 1/1998

* cited by examiner

*Primary Examiner*—Ehud Gartenberg
(74) *Attorney, Agent, or Firm*—Burns, Doane, Swecker & Mathis, L.L.P.

(57) ABSTRACT

The invention relates to a method of operating a gas turbine installation (1), compressed fresh air (6, 19, 38) is branched off after a compressor (2) and supplied to an evaporator device (14), in the evaporator device (14) feed water (17, 26, 28) is evaporated, while heat is supplied, and is mixed with the fresh air (6, 19, 38) in order to generate a steam/air mixture (22, 37), the steam/air mixture (22, 37) is fed back upstream of a gas turbine (10), the heat required for the evaporation of the feed water (17, 26, 28) is at least partially extracted from an exhaust gas (12) of the gas turbine (10). In order to improve the efficiency of the gas turbine installation (1), the feed water (17, 26, 28) runs down along a wall arrangement (39) heated by the exhaust gas (12) and is subjected to the fresh air (6, 19, 38). The feed water (17, 26, 28) evaporates and mixes with the fresh air (6, 19, 38), by which means the steam/air mixture (22, 37) forms for the recirculation.

14 Claims, 1 Drawing Sheet

GAS TURBINE INSTALLATION AND AN ASSOCIATED OPERATING METHOD

This application claims priority under 35 U.S.C. §§119 and/or 365 to Appln. No. 2001 1290/01 filed in Switzerland on Jul. 13, 2001; the entire content of which is hereby incorporated by reference.

FIELD OF THE INVENTION

The invention relates to a method of operating a gas turbine installation with the features of the preamble to claim 1. The invention also relates to a gas turbine installation with the features of the preamble to claim 6. In addition, the method relates to a use of a trickling film or thin film evaporator.

BACKGROUND OF THE INVENTION

A gas turbine installation is known from WO 98/01658 which has a gas turbine with steam injection, a plurality of heat exchangers for heat recovery from the exhaust gas of the gas turbine, an evaporator and humidification device for generating the steam and a compressor for generating compressed fresh air. Fresh air is extracted from the compressor and supplied, via a plurality of heat exchangers, to the humidification device. Heated feed water, which evaporates and, together with the compressed fresh air, forms a steam/air mixture is additionally supplied to this humidification device. This steam/air mixture is recirculated via one or a plurality of heat exchangers and is injected upstream of the gas turbine, in particular upstream of the associated combustion chamber. In this arrangement, the heating of the feed water and the superheating of the steam/air mixture take place in heat exchangers to which the gas turbine exhaust gas is admitted. In this arrangement, these heat exchangers form a device for heat recovery from the exhaust gas. Furthermore, the exhaust gas can be additionally used for preheating the feed water in a further heat exchanger. The overall efficiency of such a gas turbine installation depends, in particular, on how much thermal energy is extracted from the exhaust gas emerging from the gas turbine.

An appliance is known from EP 0 843 083 by means of which a liquid fuel is treated by means of a scavenging gas in order to match the volumetric calorific value of the liquid fuel to that of a gaseous fuel. For this purpose, this appliance contains an evaporator tube, which consists of a good heat-conducting material and which interacts with a heating device. In this arrangement, the liquid fuel is introduced into the evaporator tube at the top in such a way that it runs down along the inner surface of the evaporator tube and, in the process, forms a relatively thin film. Because of the heating of the evaporator tube, the fuel film can evaporate easily. The scavenging gas is simultaneously introduced into the evaporator tube from below in such a way that it mixes with the fuel vapor; the fuel is simultaneously transported away by this means. In this way, the density of the fuel/scavenging gas mixture is adjusted in such a way that the desired volumetric calorific value results. Such an appliance can also be designated as a "trickling film or thin film evaporator".

SUMMARY OF THE INVENTION

The invention, as characterized in the claims, deals with the problem of providing an embodiment for a gas turbine installation and for an associated operating method of the type mentioned at the beginning, which embodiment permits an increased overall efficiency for the gas turbine installation.

According to the invention, this problem is solved by a method with the features of claim 1 and by a gas turbine installation with the features of claim 6. The problem on which the invention is based is also solved by an employment with the features of claim 14. Advantageous embodiments are given in the sub-claims.

Due to the application, according to the invention, of trickling film or thin film evaporation during the evaporation of the feed water, more heat can be extracted from the gas turbine exhaust gas than in the case of conventional feed water evaporation. The overall efficiency of the installation can be increased in this way. The intensive cooling effect of the trickling film or thin film evaporation is based, in particular, on the high heat transfer between the wall arrangement and the feed water and on the direct contact between the wall arrangement and the feed water running down along it.

An improvement to the evaporation effect can be achieved by the fresh air and the exhaust gas being admitted to the wall arrangement, down which the feed water runs, according to the counterflow principle.

A further improvement to the evaporation performance can be achieved by the feed water being preheated before its evaporation. For this purpose, the feed water can, on the one hand, have a heat exchange relationship, in a first heat exchanger, with the fresh air compressed, and by this means heated, in the compressor. Alternatively or additionally, the feed water can, by means of a second heat exchanger, have a heat exchange association with the exhaust gas, which has already been cooled by the trickling film or thin film evaporation. In addition, it is expedient to carry out the superheating of the steam/air mixture, likewise by means of heat contained in the exhaust gas, which superheating can be realized by means of a third heat exchanger which is, on the one hand, arranged in the steam path downstream of the trickling film or thin film evaporation and, on the other, in the exhaust gas path upstream of the trickling film or thin film evaporation.

In a particularly advantageous embodiment, at least one of the heat exchangers mentioned can form an integral unit with the trickling film or thin film evaporator, by which means line losses can be avoided.

Further important features and advantages of the invention are provided by the sub-claims, from the drawing and from the associated description of the figures using the drawing.

BRIEF DESCRIPTION OF THE DRAWINGS

A preferred exemplary embodiment of the invention is shown in the drawing and is explained in more detail in the following description. The single

DETAILED DESCRIPTION OF THE INVENTION

Figure 1:
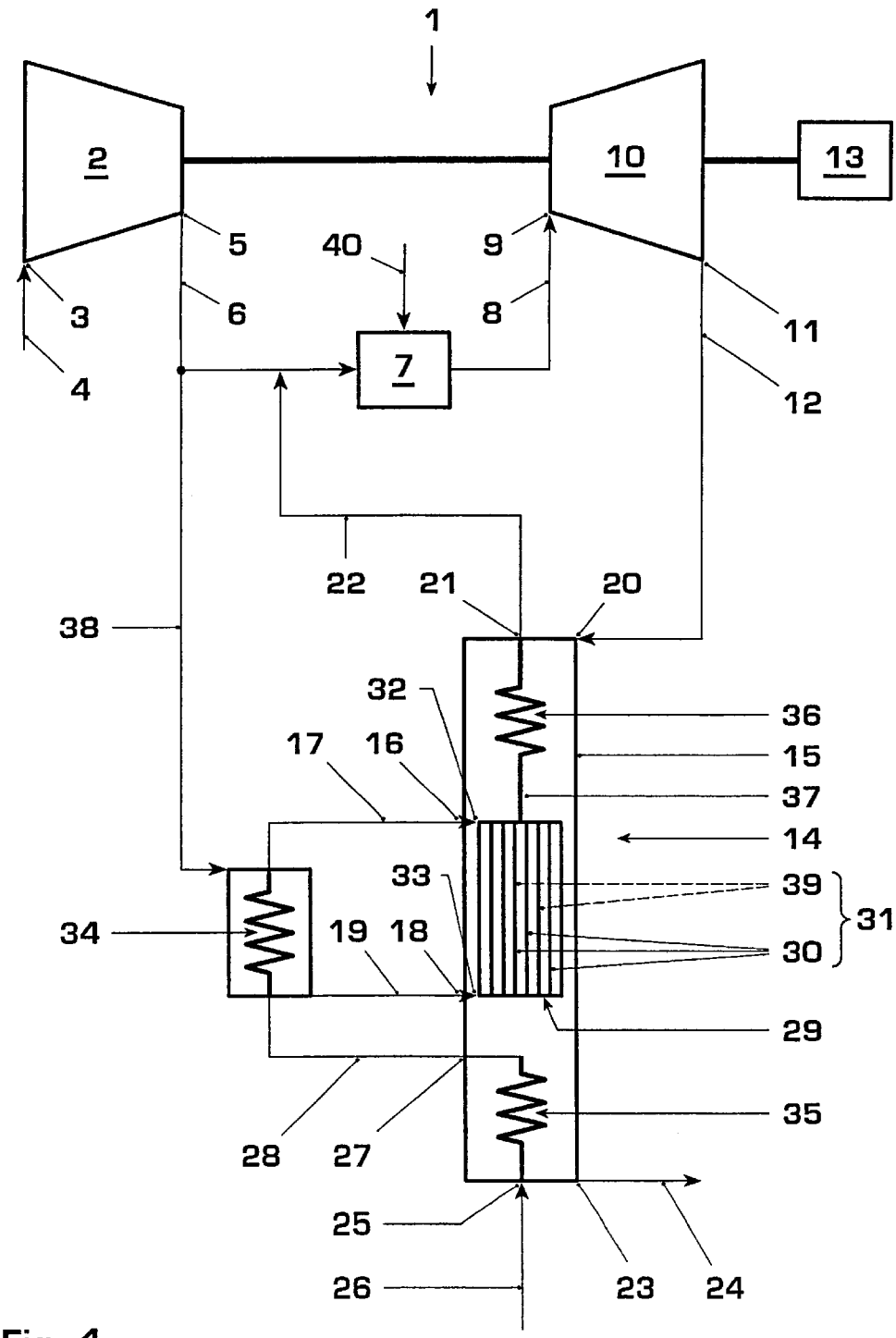
FIG. 1 shows a greatly simplified representation, in principle, of a gas turbine installation according to the invention.

A gas turbine installation 1 according to the invention has, corresponding to FIG. 1, a compressor 2, whose inlet 3 is supplied with fresh air 4, for example, from the surroundings. During operation of the gas turbine installation 1, the compressor 2 compresses the fresh air, so that compressed fresh air 6 emerges at an outlet 5 from the compressor 2. The main quantity of the compressed fresh air 6 is supplied to a combustion chamber 7 of the gas turbine installation 1 in which, in a conventional manner, combustion of a usual fuel 40, in particular natural gas, takes place. Hot and highly compressed exhaust gases 8, which are supplied to an inlet 9 of a gas turbine 10 of the gas turbine installation 1, emerge correspondingly from the combustion chamber 7. These exhaust gases are expanded in the gas turbine 10, so that expanded, hot exhaust gases 12 emerge at an outlet 11 from the gas turbine 10. In this arrangement, energy released from the gas turbine 10 is essentially used to drive the compressor 2 and to drive a consumption unit, in particular a generator 13 used for electricity generation.

The gas turbine installation 1 according to the invention is also equipped with a trickling film or thin film evaporator 14, which forms an integral unit made up of an evaporation device and an exhaust gas heat recovery device. The trickling film or thin film evaporator 14 has a casing 15, which has a water inlet 16 for feed water 17, an air inlet 18 for compressed fresh air 6 or 19, an exhaust gas inlet 20 for the hot exhaust gas 12, a steam outlet 21 for superheated steam or for superheated steam/air mixture 22, an exhaust gas outlet 23 for cooled exhaust gas 24, an additional inlet 25 for feed water 26, which has to be preheated, and an additional outlet 27 for preheated feed water 28. In addition, the casing 15 contains an evaporation line arrangement 29, which is, for example, formed from a multiplicity of tubes 30 extending parallel to one another, and is arranged in an evaporator section of the casing 15 designated by a curly bracket 31. The evaporation line arrangement 29 is supplied at 32, via the water inlet 16 and at the upper end of the individual tubes 30, with the feed water 17 to be evaporated. In this arrangement, the feed water 17 is guided in such a way that it runs down within the tubes 30 on their wall surfaces and forms a film on them which can, in particular, be thinner than 1 mm. The tubes 30, or the evaporation line arrangement 29, therefore contain, in the evaporator section 31, a wall arrangement 39, which is designated symbolically with uninterrupted line and along which the feed water 17 to be evaporated runs down.

The evaporation line arrangement 29 is supplied, at 33, with compressed fresh air 6 or 19 via the air inlet 18, i.e. at the bottom, by which means the tubes 30 have fresh air admitted to them on the inside. The feed water running down the wall arrangement 39 mentioned is correspondingly also subjected to the fresh air.

In order to supply the trickling film or thin film evaporator 14 with compressed fresh air 6, a partial flow 38 of the fresh air 6 is branched off after the compressor 2. It is likewise possible to branch off the fresh air necessary for the evaporation at another location in the compressor 2.

In the embodiment shown here, a first heat exchanger 34 is also provided which is arranged upstream of the air inlet 18 with respect to the branched-off, compressed fresh air 38 and upstream of the water inlet 16 with respect to the feed water. Feed water, on the one hand, and the compressed fresh air 38, on the other, therefore flow through this first heat exchanger 34. By this means, the feed water is preheated, whereas the compressed fresh air is cooled; the cooled fresh air is here designated by 19.

Corresponding to the special embodiment shown here, a second heat exchanger 35 is integrated into the casing 15 of the trickling film or thin film evaporator 14. Feed water flows through this second heat exchanger 35, on the one hand, and exhaust gases from the gas turbine 10 are admitted to it, on the other. This second heat exchanger 35 is arranged, with respect to the exhaust gases, downstream of the trickling film or thin film evaporator 14 and, with respect to the feed water, upstream of the first heat exchanger 34 or upstream of the water inlet 16.

In addition, a third heat exchanger 36 is arranged in the casing 15 of the trickling film or thin film evaporator 14 and, on the one hand, a steam/air mixture 37, which emerges from the evaporator section 31 of the evaporation line arrangement 29, flows through the third heat exchanger 36. On the other hand, the hot exhaust gases 12 are admitted to this third heat exchanger 36. With respect to the exhaust gases, this third heat exchanger 36 is therefore arranged upstream of the evaporator section 31 of the evaporation line arrangement 29 whereas, with respect to the steam/air mixture 37, it is arranged between the evaporator section 31 and the steam/air mixture outlet 21, i.e. upstream of the gas turbine 10. By means of its evaporator section 31, the evaporation line arrangement 29 forms an evaporation device on the inside whereas, on the outside, it forms an exhaust gas heat recovery device which can, in addition, be supplemented by the second heat exchanger 35 and/or the third heat exchanger 36.

Due to the arrangement selected, the feed water 17 running down along the evaporator wall arrangement 39 formed by the inside of the tubes 30 is subjected to the fresh air 19 on the counterflow principle. In a corresponding manner, the tubes 30 are subjected to the fresh air 19 and the hot exhaust gas 12 in the casing 15 on the counterflow principle. Flow likewise occurs on the counterflow principle through the first heat exchanger 34, the second heat exchanger 35 and the third heat exchanger 36.

The gas turbine installation 1 is, according to the invention, operated as follows:

During operation of the gas turbine installation 1, the compressor 2 compresses fresh air 6, of which the proportion designated by 38 is supplied to the first heat exchanger 34. After the first heat exchanger 34, the compressed and cooled fresh air 19 is supplied via the air inlet 18 to the evaporation line arrangement 29, in which it mixes with the feed water evaporating in the evaporation line arrangement 29, the fresh air 19 also ensuring the transport of the steam/air mixture designated by 37 out of the evaporation line arrangement 29.

The hot exhaust gases 12 enter the casing 15 at the exhaust gas inlet 20 and are admitted first to the third heat exchanger 36, superheating within it the steam/air mixture 37 so that the desired superheated steam/air mixture 22 appears. After the third heat exchanger 36, the still hot exhaust gases flow around the outside of the tubes 30. This means that the evaporation wall arrangement 39 mentioned above and along which the feed water flows on the inside, is subjected on the outside to the still hot exhaust gas. Because the tubes 30 are preferably manufactured from a relatively good heat-conducting material, for example steel, there is a relatively intense heat transfer in which, on the one hand, the exhaust gases cool relatively strongly whereas, on the other hand, intensive evaporation of the feed water is achieved. Downstream of this evaporator section 31, the still relatively warm exhaust gases are admitted to the second heat exchanger 35 and effect, within it, an initial preheating of the feed water. The relatively substantially cooled exhaust gases 24 then emerge from the casing 15 at the exhaust gas outlet 23.

At the additional inlet 25, relatively cool feed water 26 is introduced into the casing 15 or into the second heat exchanger 35, in which the first preheating, already mentioned above, of the feed water takes place. The feed water 28, preheated to this extent, emerges again at the additional outlet 27 from the casing 15 and reaches the first heat exchanger 34. A second preheating of the feed water takes place there before the feed water enters, at the water inlet 16, the casing 15 or the evaporator section 31 of the evaporation line arrangement 29. The trickling film or thin film evaporation then takes place in this evaporation section 31, the evaporated feed water mixing with the fresh air introduced at 33. In order to obtain intensive through-mixing, turbulators or the like (not described in any more detail) can be employed. It can likewise be advantageous to introduce the feed water tangentially into the individual tubes 30 in order to obtain a helical flow, for example.

The feed water steam/fresh air mixture 37 formed in the evaporator section 31 then passes into the third heat exchanger 36, in which the superheating of the steam/air mixture described above takes place. The superheated steam/air mixture 22 can then be returned to the main flow of the compressed fresh air 6 upstream of the combustion chamber 7.

An intensive heat recovery from the turbine exhaust gases is achieved by means of the trickling film or thin film evaporation in the evaporator section 31, by which means the efficiency of the overall installation 1 is increased. In addition, the integration of the second heat exchanger 35 and of the third heat exchanger 36 into the casing 15 of the trickling film or thin film evaporator 14 also leads to an increase in the overall efficiency, a particularly compact design being also achieved.

List of Designations

1 gas turbine plant
2 compressor
3 inlet to 2
4 uncompressed fresh air
5 outlet from 2
6 compressed fresh air
7 combustion chamber
8 compressed, hot exhaust gas
9 inlet to 10
10 gas turbine
11 outlet from 10
12 expanded, hot exhaust gas
13 generator
14 trickling film or thin film evaporator
15 casing of 14
16 water inlet to 15
17 feed water, preheated twice
18 air inlet to 15
19 cooled, compressed fresh air
20 exhaust gas inlet to 15
21 steam/air mixture outlet from 15
22 superheated steam/air mixture
23 exhaust gas outlet from 15
24 cooled exhaust gas
25 additional inlet to 15
26 unheated feed water
27 additional outlet from 15
28 feed water, preheated once
29 evaporation line arrangement
30 tube
31 evaporator section
32 inlet to 29 for 17
33 inlet to 29 for 19
34 first heat exchanger
35 second heat exchanger
36 third heat exchanger
37 steam/air mixture
38 branched-off, compressed fresh air
39 evaporator wall arrangement
40 fuel supply

What is claimed is:

1. A method of operating a gas turbine installation, in which compressed fresh air is branched off after or from a compressor and supplied to an evaporator device, in which, in the evaporator device, feed water is evaporated, while heat is supplied, and is mixed with the fresh air in order to generate a steam/air mixture, in which the steam/air mixture is fed back upstream of a gas turbine, in which the heat required for the evaporation of the feed water is at least partially extracted from an exhaust gas of the gas turbine, wherein the feed water runs down a wall arrangement heated by the exhaust gas and is subjected to the fresh air, the feed water evaporating and mixing with the fresh air and forming a steam/air mixture, part at least of which is supplied to the gas turbine installation.

2. The method as claimed in claim 1, wherein the wall arrangement is subjected to the fresh air and the exhaust gas according to the counterflow principle.

3. The method as claimed in claim 1, wherein the feed water is preheated upstream of the wall arrangement in a first heat exchanger, which is subjected to the fresh air before the wall arrangement is subjected to the fresh air.

4. The method as claimed in claim 1, wherein the feed water is preheated upstream of the wall arrangement and, in particular, upstream of the first heat exchanger in a second heat exchanger, which is subjected to the exhaust gas after the latter has heated the wall arrangement.

5. The method as claimed in claim 1, wherein the steam/air mixture is superheated upstream of the wall arrangement in a third heat exchanger, which is subjected to the exhaust gas before the latter heats the wall arrangement.

6. A gas turbine installation, comprising a gas turbine with steam/air injection, a device for recovering the heat from the exhaust gas of the gas turbine, an evaporator device for generating a steam/air mixture, a compressor for generating compressed fresh air, the evaporator device being supplied with feed water, compressed fresh air from the compressor and heat from the exhaust gas, wherein the device for recovering the heat and the evaporator device form a unit which is configured as a trickling film or thin film evaporator, which has a water inlet for the feed water, an air inlet for the fresh air, an exhaust gas inlet for the hot exhaust gas, an exhaust gas outlet for the cold exhaust gas, a steam/air mixture outlet for the hot steam/air mixture and an evaporator wall arrangement, along which the feed water runs down and is subjected to the fresh air, on one side, and which is subjected to the exhaust gas, on the other side.

7. The gas turbine installation as claimed in claim 6, wherein the trickling film or thin film evaporator has a casing in which is accommodated an evaporator line arrangement, which has or forms the wall arrangement in an evaporator section, the evaporation line arrangement being subjected from the outside by the exhaust gas within the casing, the feed water running down the wall arrangement and being subjected to the fresh air in the evaporator section within the evaporation line arrangement.

8. The gas turbine installation as claimed in claim 6, wherein the air inlet and steam outlet and the exhaust gas inlet and exhaust gas outlet are arranged in such a way that flow can take place through the trickling film or thin film evaporator according to the counterflow principle.

9. The gas turbine installation as claimed in claim 6, wherein a first heat exchanger is provided through which feed water can flow upstream of the wall arrangement, on one side, and fresh air can flow upstream of the wall arrangement, on the other side.

10. A gas turbine arrangement as claimed in claim 6, wherein a second heat exchanger is provided through which feed water can flow upstream of the wall arrangement, in particular upstream of the first heat exchanger, on one side, and exhaust gas can flow upstream of the wall arrangement, on the other side.

11. The gas turbine arrangement as claimed in claim 10, wherein the second heat exchanger is integrated into the trickling film or thin film evaporator, in particular into the casing.

12. The gas turbine installation as claimed in claim 6, wherein a third heat exchanger is provided through which steam/air mixture can flow downstream of the wall arrangement, on one side, and exhaust gas can flow upstream of the wall arrangement, on the other side.

13. The gas turbine installation as claimed in claim 12, wherein the third heat exchanger is integrated into the trickling film or thin film evaporator, in particular into the casing.

14. A use of a trickling film or thin film evaporator, in which a liquid medium runs down a heated wall arrangement and is subjected to a gaseous medium, the liquid medium being evaporated, mixed and led away with the gaseous medium for the recovery of heat from an exhaust gas of a gas turbine with steam injection, the exhaust gas being used for heating the wall arrangement, the liquid medium being formed by feed water, the gaseous medium being formed by fresh air compressed in a compressor and the evaporated feed water, mixed with the fresh air, forming the steam/air mixture for the injection.

* * * * *